US005237240A

United States Patent [19]

Bouchard

[11] Patent Number: 5,237,240

[45] Date of Patent: Aug. 17, 1993

[54] MERCURY VAPOR DISCHARGE LAMP CONTAINING DEVICE FOR HEATING AMALGAM-FORMING MATERIAL

[75] Inventor: Andre C. Bouchard, Peabody, Mass.

[73] Assignee: GTE Products Corporation, Danvers, Mass.

[21] Appl. No.: 802,117

[22] Filed: Dec. 4, 1991

[51] Int. Cl.[5] ..... H01J 17/02; H01J 61/52

[52] U.S. Cl. ..... 313/550; 313/490; 313/15

[58] Field of Search ..... 313/550, 13, 15, 16, 313/552, 619, 489, 490; 315/46, 47, 73, 74

[56] References Cited

U.S. PATENT DOCUMENTS

| | | | |
|---|---|---|---|
| 3,336,502 | 8/1967 | Gilliatt | 315/108 |
| 3,629,641 | 12/1971 | Holman et al. | 313/490 X |
| 3,859,555 | 1/1975 | Latassa et al. | 313/490 |
| 3,890,531 | 6/1975 | Panofski et al. | 313/490 |
| 4,904,900 | 2/1990 | Bouchard et al. | 313/491 |
| 4,907,998 | 3/1990 | Kuijer et al. | 313/490 X |
| 5,001,394 | 3/1991 | Bouchard | 131/619 |
| 5,027,030 | 6/1991 | Bouchard et al. | 313/619 |
| 5,066,892 | 11/1991 | Bouchard et al. | 315/46 |
| 5,095,336 | 3/1992 | Corona et al. | 313/490 X |

FOREIGN PATENT DOCUMENTS

| | | | |
|---|---|---|---|
| 0327346 | 8/1989 | European Pat. Off. | 61/28 |
| 2157883 | 10/1985 | United Kingdom | 61/24 |

*Primary Examiner*—Sandra L. O'Shea
*Attorney, Agent, or Firm*—Carlo S. Bessone

[57] ABSTRACT

A mercury vapor discharge lamp such as a negative glow discharge lamp includes a light-transmitting envelope containing a noble gas fill material. An anode electrode and a cathode electrode are spacedly located within the envelope. An amalgam-forming material for regulating the mercury vapor pressure of the lamp is disposed within the envelope. In order to increase the mercury vapor pressure and consequently the light output of the lamp at low ambient temperatures, a heating element is disposed within the envelope and in close thermal proximity to the amalgam-forming material. A thermostatic switch coupled to the heating element is activated when the temperature adjacent the amalgam-forming material is below a predetermined temperature.

18 Claims, 1 Drawing Sheet

MERCURY VAPOR DISCHARGE LAMP CONTAINING DEVICE FOR HEATING AMALGAM-FORMING MATERIAL

CROSS-REFERENCE TO A RELATED APPLICATION

This application discloses, but does not claim, inventions which are claimed in U.S. Ser. No. 07/802,100 filed concurrently herewith and assigned to the Assignee of this application.

FIELD OF THE INVENTION

This invention relates in general to a low-pressure mercury vapor discharge lamp, and more particularly, to a compact fluorescent lamp employing an amalgam-forming material for regulating the internal mercury vapor pressure.

BACKGROUND OF THE INVENTION

In recent years, various compact fluorescent lamps have been introduced or otherwise proposed as an alternative to incandescent lamps for general illumination. One example of a compact fluorescent lamp is one which is generally referred to as a negative glow discharge lamp. Such a lamp is typically comprised of a bulbous envelope containing a noble gas and mercury with a phosphor coating on an inner surface of the envelope. The lamp includes a pair of electrodes typically spaced about 1 to 3 centimeters apart. Examples of typical negative glow discharge lamps are found in U.S. Pat. No. 4,904,900 to Bouchard et al and U.S. Pat. No. 5,027,030 to Bouchard et al.

It is well-known that the light output of a low-pressure mercury vapor discharge lamp is a function of the mercury vapor pressure, which in turn often depends upon the temperature of the coldest region of the glass envelope of the lamp. It is further known that the envelope cold spot temperature for most efficient lamp operation is approximately 40° C., which causes a mercury vapor pressure of approximately 4 to $6\times10^{-3}$ torr to occur inside the lamp. In many installations, particularly in almost completely enclosed fixtures or where the ambient temperature rises very high at times, the lamp may be required to operate at temperatures considerably above 40° C. Such situations cause an increase in the mercury vapor pressure and a consequent reduction in light output.

To control the mercury vapor pressure within a prescribed range during such extreme situations, it is known to enclose an amalgam or an amalgam-forming material at various locations within the lamp envelope. Typical examples of compact fluorescent lamps containing an amalgam are shown and described in UK Patent Application GB2157883A and European Patent Application 0327346A2. In both of these references, a quantity of amalgam is present in an exhaust tube behind the electrode. In the latter reference a quantity of an auxiliary amalgam is also fixed to one of the lead wires.

While lamps employing an amalgam or an amalgam-forming material for regulating the internal mercury vapor pressure operate at elevated temperatures more efficiently than ordinary lamps, they suffer from the inherent drawback of lower efficiency operation at normal or low ambient temperatures. At low ambient temperatures, the vapor pressure of the mercury above the amalgam is too low to cause an efficient generation of light. Moreover, the low mercury vapor pressure associated with cold weather operation can cause destructive sputtering of the lamp cathode because of associated high cathode fall voltages.

U.S Pat. No. 3,336,502, which issued to Leland W. Gilliatt on Aug. 15, 1967, describes a mercury vapor discharge lamp containing a mercury-amalgamative metal, such as a ring of indium, on the inner surface of the lamp envelope. A heater 6 in the form of a collar embraces the lamp outside the indium ring. The heater is designed to heat the portion of the lamp at the amalgam ring to its optimum operating temperature near or at 140° F. although the ambient temperature is considerably lower. With particular attention to the embodiment depicted in FIG. 6 of the Gilliatt patent, a thermostatic switch 24 is connected between a power terminal 16 and a heater terminal 17 and located adjacent the lamp 1. The switch is adjusted to close as the ambient temperature adjacent the lamp drops below about 130° F.

While the above-described heater collar and switch may be effective, the presence of a heater collar disposed adjacent the external surface of the lamp reduces the light output from the lamp and creates a dark ring at the center of the lamp. Moreover, replacement of a failed lamp is complicated by the need to remove the heater collar from a failed lamp and then place it around a new lamp.

U.S. Pat. No. 3,859,555, which issued to Latassa et al on Jan. 7, 1975, describes a fluorescent lamp wherein an amalgam-forming material is disposed on the surface of a positive-temperature-coefficient thermistor electrically connected across one of the lamp electrodes. While this approach is effective at regulating the mercury vapor pressure of the lamp substantially independent of the ambient temperature of the lamp, a small amount of current is required to keep the thermistor heated resulting in a unnecessary use of power. In addition to consuming power during lamp operation, the thermistor is relatively expensive.

SUMMARY OF THE INVENTION

It is, therefore, an object of the present invention to obviate the disadvantages of the prior art.

It is still another object of the invention to provide an improved mercury vapor discharge lamp containing an amalgam or amalgam-forming material.

It is another object of the invention to provide an improved mercury vapor discharge lamp which does not require an external heater collar adjacent the lamp envelope.

It is still another object of the invention to provide an improved mercury vapor discharge lamp which can easily be replaced upon lamp failure.

It is yet another object of the invention to provide an improved mercury vapor discharge lamp containing a means for heating the amalgam which does not continuously consume power during lamp operation.

It is another object of the invention to provide a means for heating the amalgam which is relatively inexpensive.

These objects are accomplished in one aspect of the invention by the provision of a mercury vapor discharge lamp comprising a light-transmitting envelope containing a noble gas and a quantity of mercury. A pair of electrodes disposed in the envelope is supported by lead-in wires coupled to the electrodes and which extend through and are hermetically sealed in the envelope. A quantity of amalgam-forming material is disposed within the lamp, for example, within an exhaust tube of the lamp. Means located within the lamp and in close thermal proximity to the amalgam-forming material supplies heat to the amalgam-forming material only when the temperature adjacent the amalgam-forming material is below a predetermined temperature. In one preferred embodiment, the amalgam-forming material consists of a mixture of 67% by weight bismuth and 33% by weight indium and is heated when the temperature adjacent the material is below about 80° C.

In accordance with the teachings of the present invention, the means for supplying heat to the amalgam-forming material comprises a heating element and a thermostatic switch. In one embodiment, the heating element and the thermostatic switch are connected in series with each other. The series combination of the heating element and the thermostatic switch is connected in parallel with one of the electrodes. Preferably, the thermostatic switch is closed when the temperature adjacent the amalgam-forming material is below the predetermined temperature.

In accordance with further teachings of the present invention, the heating element and the thermostatic switch are connected in parallel with each other. The parallel combination of the heating element and the thermostatic switch is connected in series with one of the electrodes. Preferably, the thermostatic switch is open when the temperature adjacent the amalgam-forming material is below the predetermined temperature.

The above objects are accomplished in another aspect of the invention by the provision of a negative glow discharge lamp comprising a light-transmitting envelope including an exhaust tube and an ionizable medium including a noble gas and a quantity of mercury contained within in the envelope. An anode electrode is disposed within the envelope and is supported by a lead-in wire. A cathode electrode is spacedly disposed from the anode electrode and supported by a pair of lead-in wires coupled to the cathode electrode and extending through and hermetically sealed in the envelope. An amalgam-forming material is disposed within the exhaust tube. The lamp further includes means located within the lamp and in close thermal proximity to the amalgam-forming material in the tube for supplying heat to the amalgam-forming material only when the temperature adjacent the amalgam-forming material is below a predetermined temperature. The means for supplying heat to the amalgam-forming material comprises a heating element and a themostatic switch.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
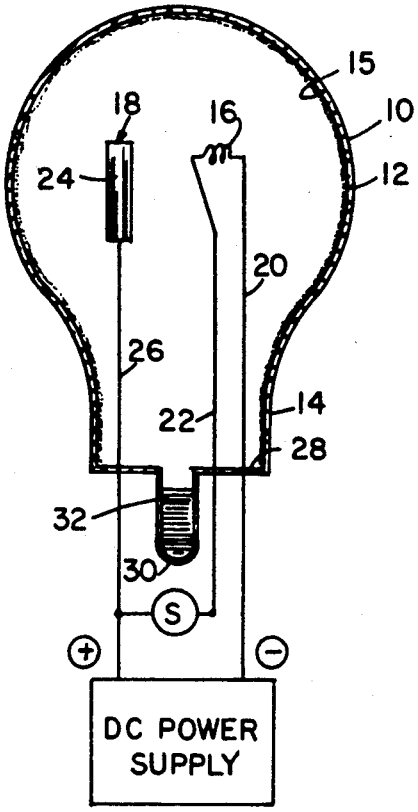
FIG. 1 represents a front elevation cross-sectional view of a negative glow discharge lamp containing an amalgam-forming material within an exhaust tube.

Referring to the drawings, FIG. 1 illustrates a mercury vapor discharge lamp, such as a negative glow discharge lamp including a light-transmitting envelope 10 having a bulbous or spherical-shaped region 12 and a neck region 14. Region 12 of envelope 10 has an internal radius of, for example, 3.5 centimeters. The inner surface of envelope 10 has a phosphor coating 15 which emits visible light upon absorption of ultraviolet radiation. Enclosed within spherical-shaped region 12 of envelope 10 there is disposed a pair of electrodes such as a cathode electrode 16 and an anode electrode 18. The electrodes are typically spaced approximately 1 to 3 centimeters apart.

According to the teachings of U.S. Pat. No. 4,904,900, anode electrode 18 may be constructed of an inexpensive strip 24 of molybdenum foil supported by a single molybdenum lead-in wire 26.

Cathode electrode 16 may be a tungsten exciter coil having a co-precipitated triple carbonate suspension, usually comprising strontium carbonate, calcium carbonate, and barium carbonate deposited thereon. The cathode electrode can vary in size, mass and geometry depending on starting features required, expected life and current carrying capabilities. During lamp manufacturing, the carbonates are converted to oxides during the well known breakdown or activation process in which current is passed through the cathode for a predetermined amount of time.

A pair of lead-in wires 20 and 22 support cathode electrode 16 and provides electrical power thereto. Lead-in wires 20 and 22 may be rod-like of say 20–30 mil diameter. Both the lead-in wires 20 and 22 are hermetically sealed, such as, by means of a wafer stem assembly 28 that closes the bottom neck region 14 of lamp envelope 10 as illustrated in FIG. 1. Lead-in wires 20 and 22 are preferably constructed of molybdenum to provide proper lamp construction and operation.

Lead-in wires 20 and 26 are respectively connected to the negative and positive terminals of a ballasted DC power supply. To start the lamp, preheat current is supplied to cathode electrode 16 by momentarily connecting together the external portions of lead-in wires 22 and 26. A conventional glow discharge starter "S" as shown in FIG. 1 may be externally secured to lead-in wires 22 and 26 to facilitate preheating and starting. Upon ignition of the lamp, a glow discharge is produced between cathode electrode 16 and anode electrode 18.

Envelope 10 contains a fill material that emits ultraviolet radiation upon excitation. This fill material may contain mercury and a noble gas, such as helium, neon, argon, krypton and xenon or a mixture of noble gases. In one embodiment, the lamp may be filled with a mixture of 99.5% neon and 0.5% argon with approximately 5 milligrams of mercury.

To control the mercury vapor pressure within a prescribed range during extreme operating conditions, it is known to enclose an amalgam or an amalgam-forming material at various locations within the envelope of a mercury vapor discharge lamp. In FIG. 1, an amalgam-forming material 30, such as 118 milligrams of a mixture of 67% by weight bismuth and 33% by weight indium, is disposed within an exhaust tube 32.

While the above-described lamp operates more efficiently at elevated temperatures when compared to a similar lamp but without an amalgam-forming material, the amalgam lamp suffers from the inherent drawback of lower efficiency operation at normal or low ambient temperatures. At low ambient temperatures, the vapor pressure of the mercury above the amalgam is too low to cause an efficient generation of light. Further, the low mercury vapor pressure associated with cold weather operation can cause destructive sputtering of the lamp cathode because of associated high cathode fall voltages.

Figure 2:
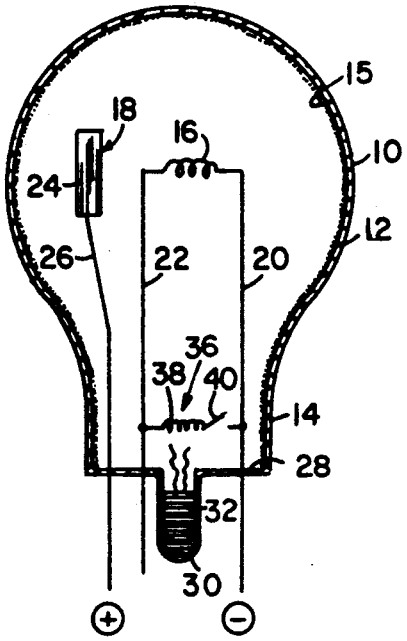
FIG. 2 represents a front elevation cross-sectional view of one embodiment of a negative glow discharge lamp constructed in accordance with the principles of the present invention.
Figure 3:
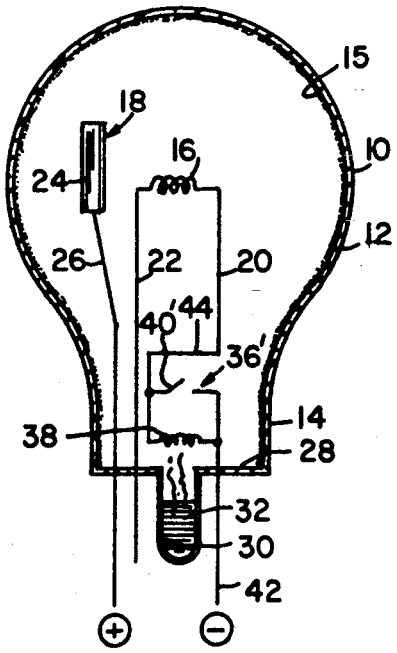
FIG. 3 represents a front elevation cross-sectional view of another embodiment of a negative glow discharge lamp constructed in accordance with the principles of the present invention.

Referring next to FIGS. 2 and 3, there are shown two embodiments of a negative glow discharge lamp according to the present invention wherein similar constituent members as those in FIG. 1 are denoted by the same reference numerals. For simplicity, the DC power supply and glow discharge starter illustrated in FIG. 1 are not shown in FIGS. 2 and 3.

With particular attention to FIG. 2, there is shown a negative glow discharge lamp containing a means 36 for automatically supplying heat to an amalgam or amalgam-forming material 30 only when the temperature adjacent material 30 is below a predetermined temperature which is related to the material used. For example, a 67/33 Bi/In alloy is used, means 36 is adapted to supply heat to the alloy material when the temperature adjacent the material is below about 80° C.

As further illustrated in FIG. 2, heat supplying means 36 is located within neck portion 14 of envelope 10 and in close thermal proximity to amalgam-forming material 32 in exhaust tube 30. In the embodiment of FIG. 2, heat supplying means 36 includes a heating element 38 and a normally-closed themostatic switch 40. Typically, heating element 38 is placed from about 0.25 to 0.50 inch from the amalgam-forming material.

In the embodiment of FIG. 2, heating element 38 and thermostatic switch 40 are shown connected in series. One end of this series combination is connected to lead-in wire 20 while the other end thereof is connected to lead-in wire 22. As a result, the series combination of heating element 38 and thermostatic switch 40 is electrically in parallel with cathode electrode 16. The contacts of thermostatic switch 40 are normally closed at room temperature and tend to operate or open at a temperature in the range of about 80° to 100° C.

Heating element 38 may consist of a piece of resistance heating wire having a cold resistance of from about 0.5 to 15 ohms. The thermostatic switch may consist of a U-shaped bimetal strip having a fixed end attached to a wire post. The other end of the bimetal is either in contact with or separated from a second wire post, depending on whether the contacts of the switch are normally open or normally closed at room temperature. The thermostatic switch may be enclosed in a small glass tube.

In operation, when the temperature adjacent the amalgam-forming material is below the optimum temperature for maximum light output (such as during cold weather operation), the contacts of thermostatic switch 40 are in a closed position prior to the application of power to the lamp. During preheating, when the external portion of lead-in wires 22 and 26 are momentarily connected together, current flows through cathode electrode 16 and heating supply 36. Following ignition of the lamp, a first portion of current flows from the negative terminal of the DC power supply through lead-in wire 20, cathode electrode 16, to anode foil 24 and through lead-in wire 26 to the positive terminal of the DC power supply. At the same time, a second portion of current flows through thermostatic switch 40 and heating element 38. In approximately 1 to 5 seconds after lamp ignition (depending upon the resistance of heating element 38), the temperature adjacent amalgam-forming material 32 reaches about 80° to 100° C. and causes the normally-closed contacts of thermostatic switch 40 to open. The opening of the contacts of switch 40 results in a complete interruption of current through heating element 38. Thereafter, the heat generated by the discharge across the anode and cathode electrodes is sufficient to maintain the contacts of switch 40 in an open condition during normal lamp operation.

In another embodiment as depicted in FIG. 3, a heating supply 36' includes a heating element 38 and a thermostatic switch 40' connected in parallel. One end of this parallel combination is connected to an internal end of a portion 42 of lead-in wire 20 which is sealed in wafer stem 28 of envelope 10. The other end of the parallel combination is connected to one end of a second portion 44 of lead-in wire 20. The other end of second lead-in wire portion 44 is connected to one end of cathode electrode 16. Effectively, the parallel combination of heating element 38 and thermostatic switch 40' is electrically in series with cathode electrode 16.

In operation, when the temperature adjacent the amalgam-forming material is below the optimum temperature for maximum light output (such as during cold weather operation), the contacts of thermostatic switch 40' are in an open condition prior to the application of power to the lamp. During preheating, when the external portion of lead-in wires 22 and 26 are momentarily connected together, current flows through cathode electrode 16 and heating element 38 of heating supply 36'. Following ignition of the lamp, current flows from the negative terminal of the power supply through lead-in wire portion 42, heater element 38, lead-in wire portion 44, cathode electrode 16 to anode foil 24 through lead-in wire 26 to the positive terminal of the power supply. In approximately 1 to 5 seconds after lamp ignition (depending upon the resistance of heating element 38), the temperature adjacent amalgam-forming material 32 reaches about 80° to 100° C. and causes the normally-open contacts of thermostatic switch 40' to close. The closing of the contacts of switch 40' results in a short-circuiting of current around heating element 38 and a cooling of heating element 38. The heat generated by the discharge across the anode and cathode electrodes is sufficient to maintain the contacts of switch 40' in a closed condition during normal lamp operation.

There has thus been shown and described an improved mercury vapor discharge lamp containing a device for automatically heating the amalgam-forming material only when the temperature adjacent the amalgam-forming material is below a predetermined temperature. The lamp can easily be replaced upon lamp failure and does not require an external heater collar adjacent the lamp envelope. Moreover, the device for heating the amalgam does not continuously consume power during lamp operation.

While there have been shown and described what are at present considered to be the preferred embodiments of the invention, it will be apparent to those skilled in the art that various changes and modifications can be made herein without departing from the scope of the invention as defined by the appended claims. For example, the amalgam-forming material may be disposed at a location other than within the exhaust tube.

What is claimed is:

1. A mercury vapor discharge lamp comprising:
- a light-transmitting envelope containing a noble gas and a quantity of mercury;
- a pair of electrodes disposed in said envelope;
- lead-in wires coupled to said electrodes and extending through and hermetically sealed in said envelope;
- a quantity of amalgam-forming material disposed within said lamp; and
- means located within said lamp and in close thermal proximity to said amalgam-forming material for supplying heat to said amalgam-forming material only when the temperature adjacent said amalgam-forming material is below a predetermined temperature.

2. The mercury vapor discharge lamp of claim 1 wherein said lamp includes an exhaust tube and wherein said amalgam-forming material is located within said exhaust tube.

3. The mercury vapor discharge lamp of claim 1 wherein said means for supplying heat to said amalgam-forming material comprises a heating element and a themostatic switch.

4. The mercury vapor discharge lamp of claim 3 wherein said heating element has a resistance within the range of from 0.5 to 15 ohms.

5. The mercury vapor discharge lamp of claim 3 wherein said heating element and said thermostatic switch are connected in series with each other, the series combination of said heating element and said thermostatic switch connected in parallel with one of said electrodes.

6. The mercury vapor discharge lamp of claim 5 wherein said thermostatic switch is closed when said temperature adjacent said amalgam-forming material is below said predetermined temperature.

7. The mercury vapor discharge lamp of claim 3 wherein said heating element and said thermostatic switch are connected in parallel with each other, the parallel combination of said heating element and said thermostatic switch connected in series with one of said electrodes.

8. The mercury vapor discharge lamp of claim 7 wherein said thermostatic switch is open when said temperature adjacent said amalgam-forming material is below said predetermined temperature.

9. The mercury vapor discharge lamp of claim 1 wherein said amalgam-forming material consists of a mixture of 67% by weight bismuth and 33% by weight indium.

10. The mercury vapor discharge lamp of claim 9 wherein said predetermined temperature is about 80° C.

11. The mercury vapor discharge lamp of claim 1 wherein said lamp is a negative glow discharge lamp.

12. A negative glow discharge lamp comprising:
- a light-transmitting envelope including an exhaust tube;
- an ionizable medium including a noble gas and a quantity of mercury contained within said envelope;
- an anode electrode disposed within said envelope and supported by a lead-in wire;
- a cathode electrode spacedly disposed from said anode electrode;
- a pair of lead-in wires coupled to said cathode electrode and extending through and hermetically sealed in said envelope;
- an amalgam-forming material disposed within said exhaust tube; and
- means located within said lamp and in close thermal proximity to said amalgam-forming material in said exhaust tube for supplying heat to said amalgam-forming material only when the temperature adjacent said amalgam-forming material is below a predetermined temperature, said means for supplying heat to said amalgam-forming material comprising a heating element and a thermostatic switch.

13. The negative glow discharge lamp of claim 12 wherein said heating element and said thermostatic switch are connected in series with each other, the series combination of said heating element and said thermostatic switch connected in parallel with said cathode electrode.

14. The negative glow discharge lamp of claim 13 wherein said thermostatic switch is closed when said temperature adjacent said amalgam-forming material is below said predetermined temperature.

15. The negative glow discharge lamp of claim 12 wherein said heating element and said thermostatic switch are connected in parallel with each other, the parallel combination of said heating element and said thermostatic switch connected in series with said cathode electrode.

16. The negative glow discharge lamp of claim 15 wherein said thermostatic switch is open when said temperature adjacent said amalgam-forming material is below said predetermined temperature.

17. The negative glow discharge lamp of claim 12 wherein said amalgam-forming material consists of a mixture of 67% by weight bismuth and 33% by weight indium.

18. The negative glow discharge lamp of claim 17 wherein said predetermined temperature is about 80° C.

* * * * *